US005522368A

United States Patent [19]

Tusino

[11] Patent Number: 5,522,368

[45] Date of Patent: Jun. 4, 1996

[54] APPARATUS AND METHOD FOR IMPROVING FUEL EFFICIENCY OF DIESEL ENGINES

[75] Inventor: Alfred J. Tusino, Kailua-Kona, Hi.

[73] Assignee: Electro-Mechanical R & D Corp., Kailua-Kona, Hi.

[21] Appl. No.: 232,943

[22] Filed: Apr. 22, 1994

[51] Int. Cl.[6] ..... F02M 17/22

[52] U.S. Cl. ..... 123/522; 123/27 GE; 123/526

[58] Field of Search ..... 123/522, 525, 123/526, 27 GE

[56] References Cited

U.S. PATENT DOCUMENTS

| | | | |
|---|---|---|---|
| 868,246 | 10/1907 | Bates | 123/522 |
| 2,357,947 | 9/1944 | Gerson . | |
| 3,395,681 | 8/1968 | Walker . | |
| 3,530,842 | 9/1970 | von Brimer | 123/522 |
| 3,616,779 | 11/1971 | Newkirk . | |
| 3,790,139 | 2/1974 | Stephenson et al. | 123/522 |
| 3,792,688 | 2/1974 | Grainger . | |
| 3,800,533 | 4/1974 | Zankowski . | |
| 3,800,768 | 4/1974 | Rhodes . | |
| 3,931,801 | 1/1976 | Rose . | |
| 4,003,356 | 1/1977 | Naylor . | |
| 4,011,847 | 3/1977 | Fortino . | |
| 4,076,002 | 2/1978 | Mellqvist et al. | 123/522 |
| 4,175,525 | 11/1979 | Johnson | 123/522 |
| 4,368,711 | 1/1983 | Allen | 123/522 |
| 4,409,946 | 10/1983 | Sandford . | |
| 4,450,820 | 5/1984 | Haynes . | |
| 4,454,848 | 6/1984 | Duprez . | |
| 4,476,841 | 10/1984 | Duckworth | 123/522 |
| 4,562,820 | 1/1986 | Jiminez . | |
| 4,644,925 | 2/1987 | Hoppie . | |
| 4,656,979 | 4/1987 | Hogenson . | |
| 4,681,081 | 7/1987 | LaPan | 123/522 |
| 4,688,537 | 8/1987 | Calkins . | |
| 4,736,718 | 4/1988 | Linder . | |
| 4,807,584 | 2/1989 | Davis . | |
| 4,955,351 | 9/1990 | Lewis . | |
| 4,984,554 | 1/1991 | Ariga . | |
| 5,211,890 | 5/1993 | Wentworth . | |

FOREIGN PATENT DOCUMENTS

| | | |
|---|---|---|
| 258215 | 7/1988 | German Dem. Rep. . |

OTHER PUBLICATIONS

Kirk–Othmer, "Gasoline and Other Motor Fuels," Encyclopedia of Chemical Technology, Third Edition, vol. 11, pp. 652–655, 682–685.

*Primary Examiner*—Erick R. Solis
*Attorney, Agent, or Firm*—Martin E. Hsia

[57] ABSTRACT

A method and apparatus for increasing fuel economy of a diesel fuel engine in which an aerator (40) bubbles air through diesel fuel (F) in a diesel fuel tank (T) to generate diesel fuel fumes in the ullage (U). In a turbocharged diesel engine, the fumes are directed by a valve (60) to fume injectors 86 and injected just before the turbo charger fan (32). In a normally aspirated engine, the fumes are directed by a valve (160) to the intake manifold (124).

29 Claims, 3 Drawing Sheets

FIG. 1
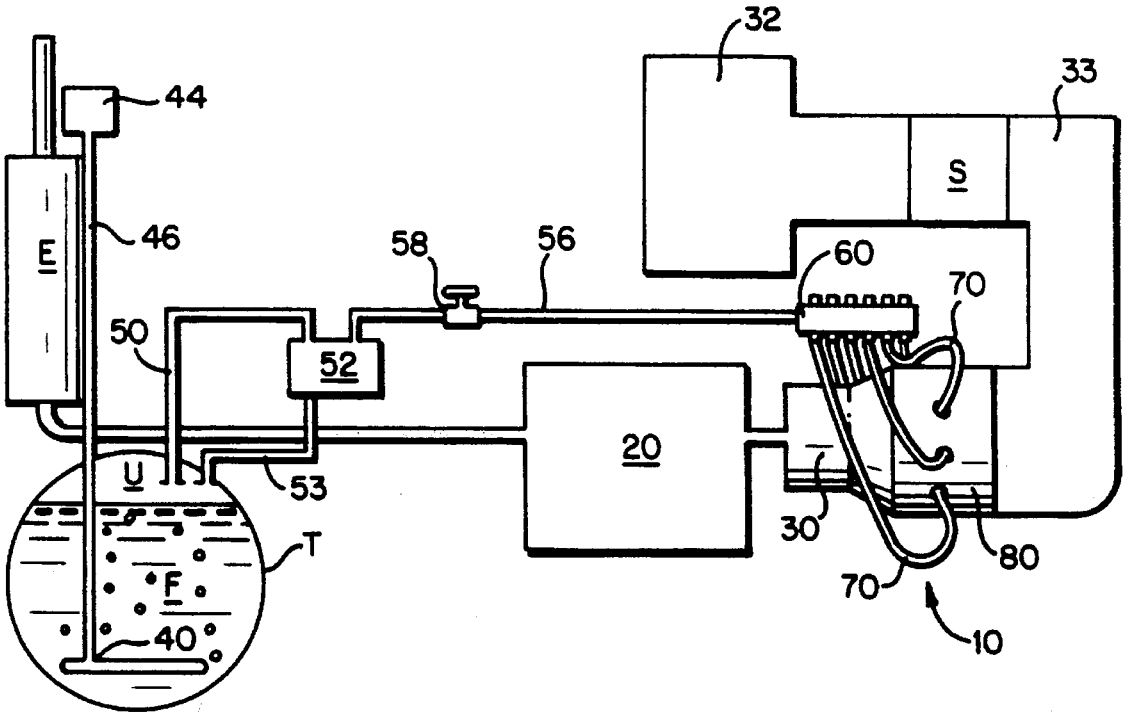
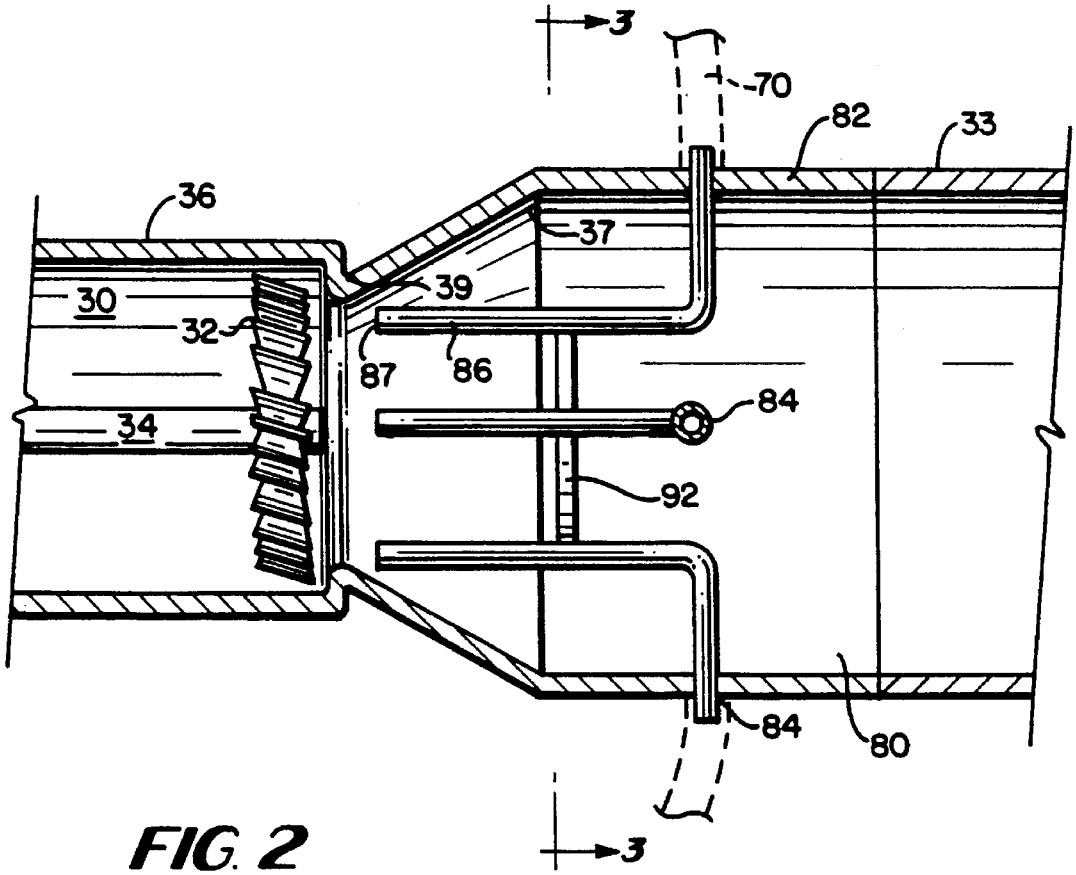
FIG. 2

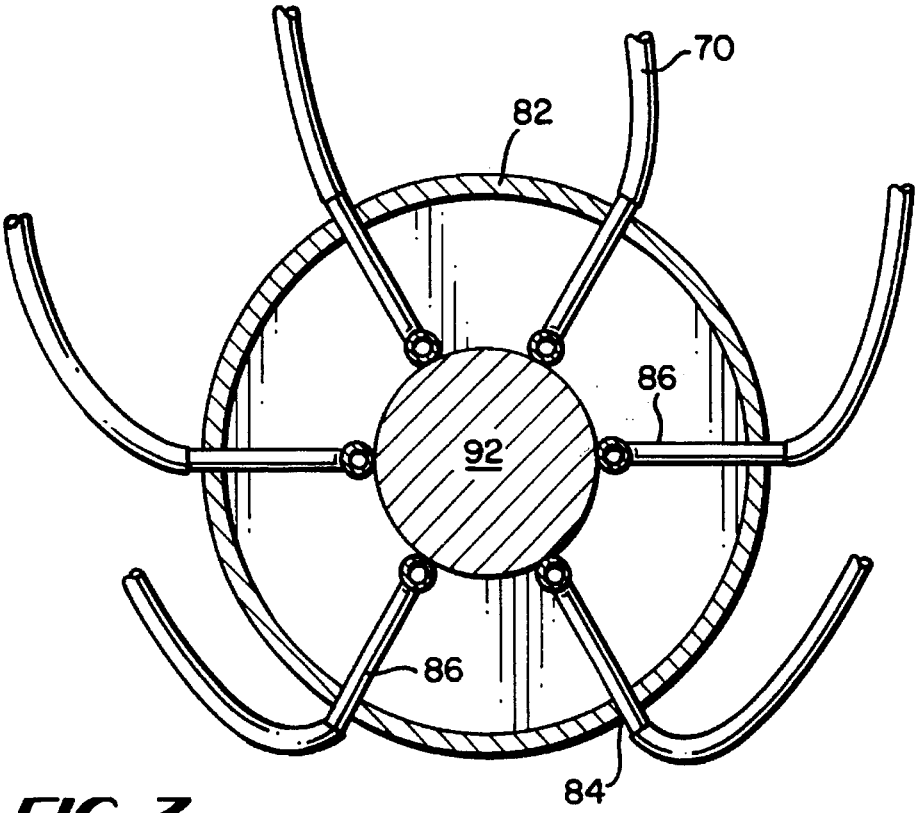
FIG. 3
FIG. 4
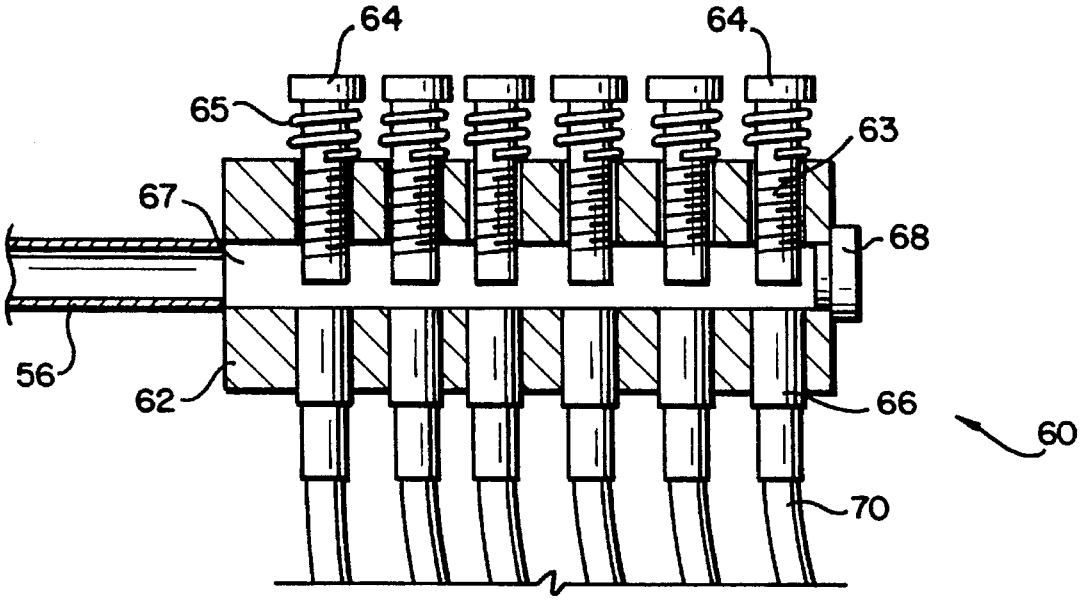

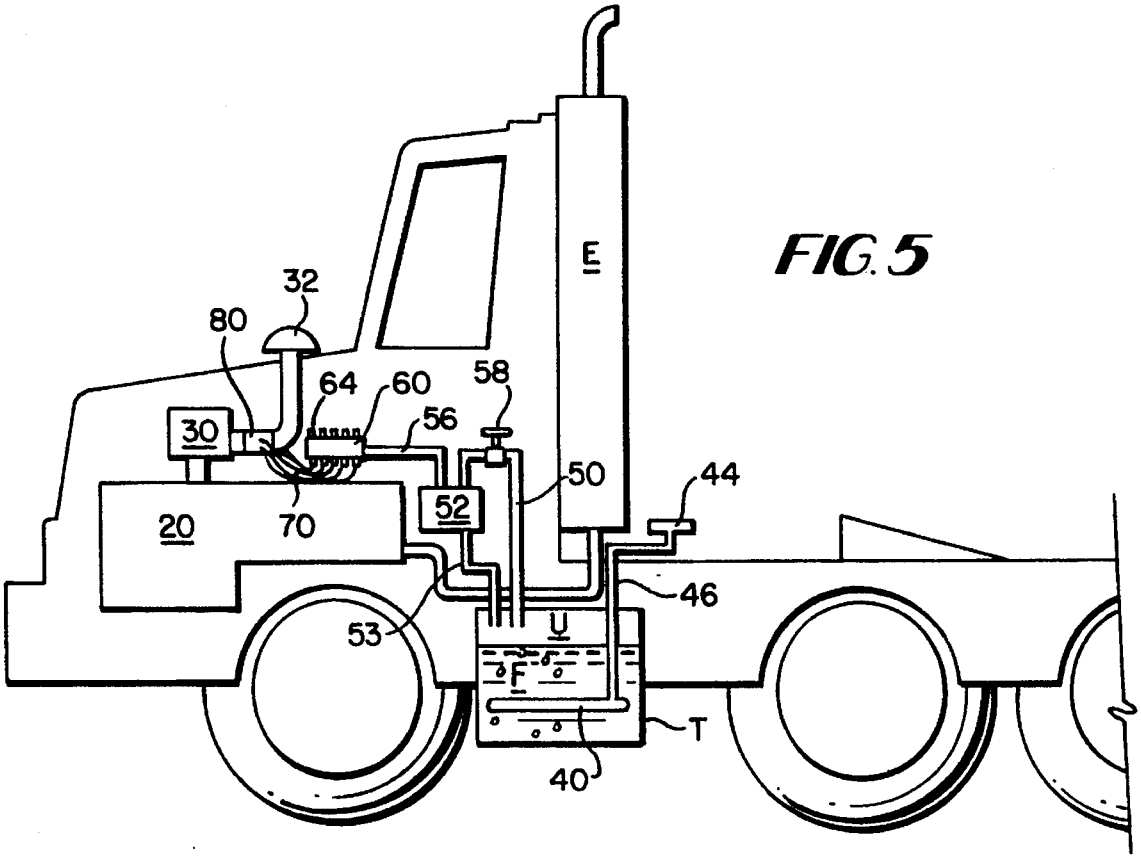
FIG. 5
FIG. 6
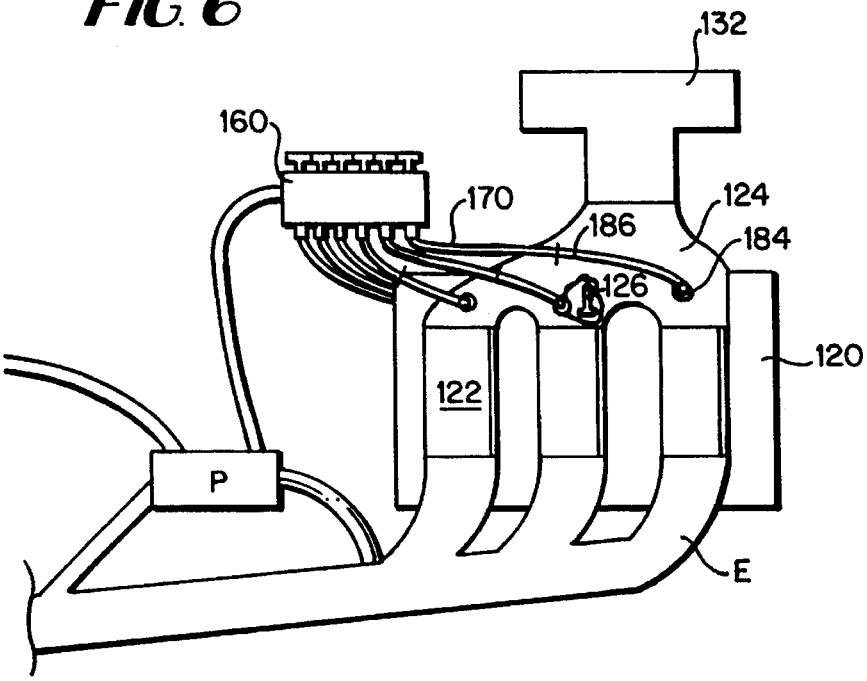

APPARATUS AND METHOD FOR IMPROVING FUEL EFFICIENCY OF DIESEL ENGINES

TECHNICAL FIELD

This invention relates to an apparatus and method for improving fuel efficiency of diesel engines.

Diesel engines are used throughout the industrial world for various purposes including transportation, power equipment and manufacturing. Diesel engines use a diesel fuel which is made of heavier petrochemical ingredients than gasoline or other types of fuels commonly used in other internal combustion engines. Methods have long been sought to increase the efficiency of diesel engines in order to achieve increased fuel efficiency and economy, especially in the transportation industry, more specifically in the trucking industry.

Many goods are transported by tractor trailer trucks on highways. The trucking industry is highly competitive and price sensitive. Many tractor trailer trucks in the trucking industry use diesel engines.

It is therefore an object of this invention to provide an apparatus and method for increasing the fuel efficiency of diesel engines.

It is a further object of this invention to provide such an apparatus and method that can be easily retrofitted onto an existing diesel engine, whether the engine is turbocharged or normally aspirated.

It is a still further object of this invention to provide such an apparatus and method that is easy and economical to install on existing diesel engines.

It is a still further object of this invention to provide such an apparatus and method that decreases the amount of air pollution created by diesel engines.

BACKGROUND ART

Many attempts have been made to provide increased fuel efficiency in internal combustion engines. However, most of these efforts have been directed to gasoline engines, which are more common than diesel engines, and which operate on different principles, using different fuels. For example, gasoline engines use gasoline, which contains a high proportion of volatile petrochemical ingredients. Gasoline engines ignite gasoline using spark plugs. By contrast, diesel engines use a heavier fuel with a lower proportion of volatile petrochemical ingredients, and ignite diesel fuel using temperature increases caused by air compression. Both gasoline and diesel engines can be provided with air at ambient pressures ("normally aspirated"), or can be provided with air at greater than ambient pressures through devices that increase the flow of air into the engine, commonly called turbochargers, which are driven by exhaust gasses, or superchargers, which are driven by the engine itself or independently of the engine (all devices for increasing air flow through an engine are hereinafter collectively referred to as "turbochargers").

Many attempts have been made to provide apparatus and methods for increasing the efficiency of internal combustion engines.

U.S. Pat. No. 3,395,681 to Walker discloses a fuel evaporator and economizer for internal combustion engines that takes wasted crank case gases and bubbles them upwards through gasoline to saturate fully those gases with gasoline, and then provides those saturated gases to the fuel supply chamber.

U.S. Pat. No. 3,800,768 to Rhodes et al. discloses a method and apparatus for bubbling air through gasoline to provide a mixture of air and low boiling point (volatile) gasoline components, and combusting that mixture until pollution control devices have warmed up.

U.S. Pat. No. 4,011,847 to Fortino discloses a device that bubbles air from a compressor (or drawn through engine vacuum) through a supply of liquid petroleum to be conducted directly to the carburetor or engine intake manifold.

U.S. Pat. No. 3,800,533 to Zankowski discloses a device that bubbles air through a volatile liquid fuel to reduce carbon monoxide and nitrogen oxides. This device oxidizes exhaust products by thermal oxidation, without further combustion or afterburning, and uses small apertures to form small bubbles.

U.S. Pat. No. 3,931,801 to Rose et al. discloses a device that bubbles exhaust gases through fuel to heat and vaporize the fuel before mixing it with air at the entrance to the intake manifold. The engine then burns only vaporized fuel and not liquid fuel.

U.S. Pat. No. 4,562,820 to Jiminez discloses a device that vaporizes gasoline using cavitation. When greater power is needed, this device mixes partially vaporized fuel and air with the gasoline vapor.

U.S. Pat. No. 4,807,584 to Davis discloses a fuel tank heating system for warming fuel before it is delivered to an engine.

U.S. Pat. No. 4,688,537 to Calkins et al. discloses an apparatus for preventing freeze up of a pressure regulator valve in a liquefied petroleum fuel system.

U.S. Pat. No. 2,357,947 to Gerson discloses a fuel feed system for natural gasolines and other high vapor pressure fuels to overcome operating difficulties at low temperatures.

U.S. Pat. No. 3,616,779 to Newkirk discloses an internal combustion engine powered by a gaseous fuel such as hydrogen.

U.S. Pat. No. 3,792,688 to Grainger discloses an anti-pollution gasified liquid fuel system in which air is bubbled through a liquid fuel to produce a gaseous fuel which is fed directly to an internal combustion engine or burned in a steam boiler producing steam to operate a turbine, a reciprocating steam engine or any other steam actuated device.

U.S. Pat. No. 4,644,925 to Hoppie et al. discloses an apparatus and method for compressive heating of fuel to achieve hypergolic combustion.

U.S. Pat. No. 4,656,979 to Hogenson discloses an in-tank fuel line heater.

U.S. Pat. No. 4,003,356 to Naylor discloses a vaporized fuel system for internal combustion engines.

U.S. Pat. No. 4,409,946 to Sandford et al. discloses a fuel supply for internal combustion engines that includes a vessel to provide fuel vapor and a nozzle to mix the vapor with air.

U.S. Pat. No. 4,736,718 to Linder discloses a combustion control system for internal combustion engines that includes a novel spark plug having a precombustion chamber in which a butane/air mixture is injected.

U.S. Pat. No. 4,955,351 to Lewis et al. discloses a vapor-accelerated combustion fuel system that produces and meters a constant supply of volatile gasoline vapors into the cylinders of an internal combustion gasoline engine.

U.S. Pat. No. 5,211,890 to Wentworth, Jr. discloses an ion vapor generator device for producing negatively charged ions from a liquid comprising water for enhancement of combustion processes.

German Patent 258215 to Wenige et al. discloses a method and apparatus for aerating waste water and streams of material that consume oxygen by compressing the liquid so the air globules are compressed to microbubbles and then dispersing the microbubbles at the circumference of a rotary body.

During the 1970's, when the inventor ran a gravel pit mining business, the inventor unsuccessfully experimented with various devices that injected gasoline fumes at the carburetor of a gasoline engine for combustion or, in turbocharged gasoline engines, injected those fumes into the turbocharger. In the 1970's, the inventor installed experimental devices on normally aspirated (without turbochargers or superchargers) diesel vehicles that injected diesel fuel fumes through a 1 inch (approximately 2.5 centimeters) tube into the center of the intake manifold of an in line 6 cylinder engine. These devices did not substantially increase fuel efficiency. In the 1970's, the inventor also unsuccessfully experimented with injecting diesel fuel fumes into air flowing into the turbocharger fan of a turbocharged diesel engine from a single ½ inch (approximately 1.3 centimeters) diameter tube with an outlet end spaced approximately 3 inches (approximately 7.8 centimeters) away from the turbocharger fan. This experiment also was unsuccessful. None of these devices aerated or heated the gasoline or diesel fuel, or used a pump to pump fuel fumes through fume injectors. These devices were installed only on vehicles in the inventor's own fleet, and were removed from those vehicles before the vehicles were sold when that business was closed.

Most of the above references relate to gasoline fuel or other liquid fuels containing a high proportion of volatile petrochemical ingredients. Further, several references teach that gasses, including air, should be removed from a diesel fuel before combustion.

U.S. Pat. No. 4,454,848 to Duprez discloses a diesel fuel control apparatus and system that converts heated excess fuel having air entrained therein to heated fuel without air to mix with fuel flowing from the fuel tank.

U.S. Pat. No. 4,450,820 to Haynes discloses an engine fuel conditioner and monitor that degases fuel by atmospheric venting through a hydrostatic liquid column.

U.S. Pat. No. 4,984,554 to Ariga et al. discloses a fuel feed system that bleeds air from fuel having air bubbles entrained therein.

DISCLOSURE OF THE INVENTION

The apparatus of this invention comprises:

fume intake means for receiving diesel fuel fumes in the diesel fuel tank in gaseous communication with the diesel fuel tank;

fume injector means for injecting the diesel fuel fumes into the turbocharger fan spaced apart from the turbocharger fan, the fume injector means and the turbocharger fan defining an injector separation distance; and control valve means for controlling flow of the diesel fuel fumes through the fume injector means operably connected between the fume intake means and the fume injector means;

so that the turbocharger fan draws diesel fuel fumes from the diesel fuel tank, through the fume intake means, the control valve means and the fume injector means, and injects the diesel fuel fumes into air flowing into the turbocharger inlet.

Preferably, an aerator means for aerating the diesel fuel to create diesel fuel fumes is operably connected to the diesel fuel tank and an aerator pipeline having an aerator end and an air filter end is attached at the aerator end to the aerator means, with an aerator air filter attached to the air filter end.

Preferably also a safety reservoir means is connected between the diesel fuel tank and the control valve means for preventing diesel fuel from flooding the apparatus.

Preferably the injector separation distance is between approximately 1½ inches (approximately 4 centimeters) and approximately ½ inch (approximately 1.3 centimeters). Optimally the injector separation distance is approximately 1 inch (approximately 2.5 centimeters).

Preferably the fume injector means comprises a plurality of fume injectors defining an array of fume injector outlet ends. Preferably also the control valve means independently controls flow of fuel fumes through each of the plurality of the fume injectors.

Surprisingly, the invention has approximately doubled the fuel economy of diesel engines used on trucks.

Other objects, features and advantages of the present invention will become more fully apparent from the following detailed description of the presently preferred embodiments, the claims and the accompanying drawings.

BRIEF DESCRIPTION OF DRAWINGS

FIG. 1 is a schematic view of a presently preferred embodiment for carrying out the present invention on a diesel engine having a turbocharger;

FIG. 2 is a side elevational cutaway view of the fume injector and turbocharger assembly of FIG. 1;

FIG. 3 is a view along the line 3—3 of FIG. 2;

FIG. 4 is a side elevational cutaway view of a presently preferred embodiment of the control valve of FIG. 1;

FIG. 5 is a side elevational view of a vehicle retrofitted with the embodiment of FIG. 1; and FIG. 6 is a side elevational view of a presently preferred embodiment for carrying out the present invention on a normally aspirated diesel engine.

BEST MODES FOR CARRYING OUT INVENTION

The best modes presently contemplated for carrying out the present invention are the preferred embodiments illustrated by way of example in FIGS. 1–6.

Referring to FIG. 1, shown is a schematic diagram of a presently preferred embodiment 10 of the present invention retrofitted onto an existing diesel engine 20 having a turbocharger 30 that is provided with filtered air drawn through a turbocharger filter 32 and a turbocharger air supply tube 33. An aerator 40 is installed in a fuel tank T and is supplied with air drawn through an aerator air filter 44 and an aerator pipeline 46. Presently it is preferred that the aerator pipeline 46 be in thermal contact with the exhaust system E of the engine 20 so that the air drawn through the aerator pipeline 46 is warmed by the exhaust system E before bubbling up through the aerator 40. A fume intake pipe 50 is inserted into the space above the fuel F, commonly known as the ullage U. The fume intake pipe 50 leads to a safety reservoir 52 which intercepts and holds any liquid fuel F that is accidentally drawn through the fume intake pipe 50. The safety reservoir 52 preferably has a capacity of approximately 1½ quarts (approximately 1.4 liters) and is preferably provided with a drain 53 leading to the tank T so that any liquid fuel F drawn into the reservoir 52 drains into the tank T. Without a reservoir 52, if the fuel tank T is filled completely so that there is insufficient ullage U, liquid fuel will be drawn into the fume intake pipe 50 and flood the system, rendering it inoperable. A valve supply pipe 56 leads from the safety reservoir 52 to a control valve 60. Optionally, a shutoff valve 58 may be provided on the valve supply pipe 56. The control valve 60 controllably distributes fumes from the valve supply pipe 56 to a plurality of fume supply hoses 70. The fume supply hoses 70 are connected to a fume injector assembly 80 that is mounted on the turbocharger 30.

Referring to FIG. 2, shown is a side elevational cutaway view of the fume injector assembly 80 as installed between the turbocharger 30 and the turbocharger air supply tube 33.

The turbocharger 30 is conventionally provided with a fan 32 mounted on a shaft 34 that is conventionally driven by exhaust from the engine 20. The turbocharger is conventionally enclosed in a housing 36 having a turbocharger inlet portion 37 somewhat larger than the diameter of the fan 32 and that tapers down to a fan portion 39 that is slightly smaller in diameter than the diameter of the fan 32. Typically, the diameter of the turbocharger inlet portion is approximately 5 inches (approximately 13 centimeters) and typically the diameter of the fan portion is approximately 3 inches (approximately 8 centimeters). Conventionally, the turbocharger air supply tube 33 also is approximately 5 inches (approximately 13 centimeters) in diameter and is mounted over the turbocharger air inlet 37 with an air tight seal. Of course, this invention is applicable to other types of turbochargers (now known or later developed), but a conventional turbocharger structure is disclosed for simplicity and ease of understanding.

In order to install the fume injector assembly 80 of the preferred embodiment between the turbocharger air supply tube 33 and the turbocharger air inlet 37 without relocating the turbocharger air filter 32, it is presently preferred to insert a spacer pipe S (see FIG. 1) at an elbow joint in the turbocharger air supply tube 33. Alternatively, an appropriate length of turbocharger air supply tube 33 can be cut off.

The fume injector assembly 80 of the present invention comprises a ported sleeve 82 having a plurality, preferably six, of fume injector ports 84, with a single preferably approximately L shaped fume injector pipe 86 connected to each of the fume injector ports 84. The preferred material for the ported sleeve 82 is PVC pipe, steel, aluminum or other suitable rigid material. Because the ported sleeve 82 will not be in a high temperature environment, the material is not critical. The preferred material for the fume injector pipes 86 is copper tubing because it is sufficiently rigid to remain in position, although any other similarly rigid material can be used instead. Preferably, also, the fume injector pipes 86 have an inside diameter of approximately ¼ inch (approximately 0.5 centimeter).

The fume injector pipes 86 are arranged so that their outlet ends 87 are disposed in an approximately circular fume injector array approximately parallel to, spaced apart from, and concentric with, the turbocharger fan 32, and the fume injector pipes 86 are spaced apart by approximately equal angular distances in that array. Preferably also, the fume injector pipes 86 are maintained in position by a preferably circular pipe spacer 92 positioned parallel to, spaced apart from, and concentric with the turbocharger fan 32 so that the outlet ends 87 of the fume injector pipes 86 are preferably between approximately 1½ inches (approximately 4 centimeters) and approximately ½ inch (approximately 1.3 centimeters), and optimally approximately 1 inch (approximately 2.5 centimeters) from the turbocharger fan 32. Preferably the circular fume injector array has a diameter approximately half the diameter of the turbocharger fan 32. Preferably the pipe spacer 92 comprises a copper disk approximately 2 inches (approximately 5 centimeters) in diameter and is spaced between approximately 2 inches (approximately 5.2 centimeters) and approximately 5 inches (approximately 12.8 centimeters) away from the turbocharger fan 32. The use of a centrally obstructing pipe spacer 92 is somewhat critical because the use of only a single large fume injector pipe does not increase mileage as much as the preferred embodiment. The fume supply hoses 70 are preferably attached to the ports 84 on the ported sleeve 80. The preferred inside diameter of the fume injector hose 70 is approximately ¼ of an inch (approximately 0.5 centimeter) and it is preferred that those hoses be made of rubber vacuum tube or vinyl.

If the turbocharger fan 32 is greater or less than approximately 3 inches (approximately 8 centimeters) in diameter, then the other dimensions and the number of fume injector ports 84 and corresponding fume injector pipes 86 would be commensurately increased or decreased, but the preferred spacing between the outlet ends 87 of the fume injector pipes 86 and the turbocharger fan 32 would preferably remain unchanged. For example, if the turbocharger fan 32 has a diameter of approximately 2 inches (approximately 5 centimeters), then it is preferred that four fume injector ports 84 and four fume injector pipes 86 be provided, and that the pipe spacer 92 have a diameter of approximately an inch (approximately 2 centimeters). However, it is still preferred that the distance between the outlet ends 87 of the fume injector pipes 86 be between approximately 1½ inches (approximately 4 centimeters) and approximately ½ inch (approximately 1.3 centimeters), and optimally approximately 1 inch (approximately 2.5 centimeters) from the turbocharger fan 32. If the fume injector pipes 86 will each have the preferred inside diameter of ¼ inch (approximately 0.5 centimeters), then it would be preferred to have one fume injector pipe for each cylinder in the engine 20. Of course, if the size of the fume injector pipes is increased or decreased, the number of fume injector pipes should be commensurately increased or decreased to maintain the preferred rate of injection of diesel fuel fumes.

Referring to FIG. 3 shown is a front elevational view of the ported sleeve assembly along the line 3—3 of FIG. 2. A plurality, preferably 6, of preferably radially disposed, preferably approximately equally spaced, ports 84 is provided in the ported sleeve 82. The injector pipes 86 are mounted in the ports 84 and extend radially inward approximately half way towards the axis of the ported sleeve 82. A preferably circular pipe spacer 92 is preferably placed on the axis of the ported sleeve 82 and preferably retains all of the injector pipes 86 in position. The injector pipes 86 preferably then extend towards the turbocharger fan 32 as shown in FIG. 2. Thus, a plurality of fume injector pipes 86 injects fumes into the air flow going through the turbocharger fan 32.

Referring to FIG. 4, shown is an elevational cutaway view of the control valve assembly 60, comprising a control valve body 62 having a plurality, preferably 6, bolt apertures 63, into which a corresponding plurality of bolts 64 is threadingly engaged. Preferably springs 65 are provided between the control valve body 62 and the heads of the bolts 64. A plurality of fittings 66 is preferably provided on the portion of the control valve body 60 opposite the bottoms of the bolts 64. A central chamber 67 is provided in the center of the control valve body 62 and is plugged by a main plug 68 at the end opposite the valve supply pipe 56. The fume injector hoses 70 are attached to the fittings 66. The distribution of fumes from the control valve assembly 60 into each of the fume injector hoses 70 can be independently controlled merely by adjusting each of the bolts in the valve assembly 60. However, the engine must be retuned after installation of the apparatus in order to adjust the idle setting because the engine will substantially increase its speed when fumes are injected into the turbocharger. The structure and type of control valve 60 are not critical as long as the amount of fumes distributed to each of the fume injector hoses 70 is independently adjustable, and any other valves that can controllably distribute fuel fumes from the valve supply pipe 56 to the fume injector hoses 70 are considered to be within the scope of this patent.

As can be seen from the above description of the first presently preferred embodiment, it is relatively simple to retrofit this device onto an existing diesel engine because no alterations to the functions of the turbocharger or the engine are necessary. All that is required is the appropriate positioning of fume injectors in the air stream for the turbocharger, a means for aerating the fuel F in order to create fumes in the ullage U of the tank T, and a means for transporting the fumes from the ullage U into the fume injectors 86 so that the fumes can be mixed with the air flow into the turbocharger 30. FIG. 5 illustrates a vehicle (a tractor trailer truck) retrofitted with the embodiment of FIG. 1.

In operation, the turbocharger 30 creates a suction in the ullage U as described below. This suction causes air to be drawn through the aerator air filter 44 and the aerator pipeline 46. The filtered air is warmed by the exhaust system E which is in thermal contact with the aerator pipeline 46 and then air bubbles rise through the fuel F from the aerator 40, thus aerating the fuel F and creating fumes in the ullage U. The fumes are drawn through the fume intake pipe 50 and through the safety reservoir 52. If the level of the fuel F in the tank T is so high that fuel is drawn through the fume intake pipe 50, that fuel will be trapped in the safety reservoir 52 and will be prevented from travelling any further into the system or flooding the system. Any fuel trapped in the safety reservoir 52 will drain into the tank T through drain 53. The fumes then travel through the control valve supply pipe 56 into the control valve assembly 60. The fumes are then controllably distributed to the various fume injector hoses 70 by the control valve assembly 60. The quantity of fumes travelling through each fume injector hose 70 can be independently controlled by the bolts 64. The fumes then travel through the fume injector hoses 70 and into the fume injector pipes 86. The fumes are then injected from the outlet ends 87 of the fume injector pipes 86 into the air stream generated by the turbocharger fan 32. The fumes then travel through the conventional turbocharger assembly 30 and are injected into the engine 20 together with the air from the turbocharger assembly 30.

The entire system is driven by the suction created by the existing turbocharger so that no auxiliary motors or other powered devices are necessary. However, auxiliary motors, pumps, and other devices to increase or control the air supply or fume supply into the turbocharger can be used if desired.

It should be noted that aeration and heating of the diesel fuel in order to increase diesel fuel fumes, although preferred, is not critical to the invention. Diesel engines do not burn all of the fuel introduced into the engine during combustion, and the unused fuel is usually recycled into the fuel tank. However, this recycled fuel usually has been heated and aerated. Indeed, the prior art teaches that the air in the recycled fuel must be removed prior to being recycled into the fuel tank, as evidenced by, for example, U.S. Pat. No. 4,454,848 to Duprez, U.S. Pat. No. 4,450,820 to Haynes and U.S. Pat. No. 4,984,554 to Ariga, et al., described above. The invention significantly improves diesel fuel mileage even without aeration and heating, but the inventor has found that the invention works better when the diesel fuel is aerated and heated as disclosed above.

Referring to FIG. 6, shown is an alternative preferred embodiment of the present invention installed on a V-6 diesel engine 120 having six cylinders 122 but not a turbocharger. Air is provided to the cylinders 122 by an intake manifold 124 that is supplied with air drawn in through an air filter 132, and an air intake valve 126 (shown schematically) is provided at the head of each cylinder, as is conventional. All of the valves, cams and other structure are omitted for clarity, except for a schematically shown single air intake valve 126 on one cylinder.

In this embodiment, the aerator and tank assembly are similar to the embodiment of FIG. 1 and are also omitted for clarity. The control valve 160 is similar to the control valve 60 shown in FIG. 4. However, instead of a ported sleeve, fume injector ports 184 are formed directly in the intake manifold 124 adjacent to the air intake valves 126 for the cylinders 122. Fume injector pipes 186, preferably of bendable copper, then extend through the fume injector ports 184 into the intake manifold 124 to within a distance as close as possible to the air intake valves 126, and preferably within less than approximately one inch (approximately 2.5 centimeters) from each of the air intake valves 126. The ends of the fume injector pipes 186 near the air intake valves 126 are preferably cut at an angle to increase the amount of fumes that can be drawn through them. Fume injector hoses 170 then distribute fumes from the control valve 160 into the fume injector pipes 186, which inject diesel fuel fumes as close as possible to the air intake valve 126 of each cylinder, preferably less than 1 inch (approximately 2.5 centimeters) away from the air intake valve 126. The preferred dimensions and materials for the fume injector hoses and fume injector pipes are the same as in the prior embodiments. Because there is no turbocharger, a pump P is preferably used to pump fumes from the fuel tank T to the control valve 160 and to draw air into the fuel tank T through the aerator 40 to create fumes. However, the pump P is not necessary as substantial gains in fuel economy have been obtained without a pump, as shown in Example 2 below. Preferably, the pump P comprises a conventional pump, preferably a squirrel cage pump, driven by a portion of the gas drawn off from the exhaust manifold E.

EXAMPLE 1

The embodiment of FIG. 1 was installed on the engines in two tractor trucks. The first was a 1978 Peterbilt tractor with a turbocharged six cylinder in line diesel engine with a displacement of 855 cubic inches (approximately 14,013 cubic centimeters) and a 5 inch (approximately 13 centimeters) turbocharger, rated for 280 horsepower (approximately 209 kilowatts). The second was a 1980 Peterbilt water truck with a turbocharged six cylinder in line diesel engine with a displacement of 855 cubic inches (approximately 14,013 cubic centimeters) and a 5 inch (approximately 13 centimeters) turbocharger rated for 280 horsepower (approximately 209 kilowatts). After installation of the device but with the shutoff valve 58 disabled, both trucks obtained an average of approximately 4 to 5 miles per gallon (approximately 1.9 kilometers per liter) of diesel fuel while being driven approximately 3,500 miles (approximately 5,600 kilometers). This was the same mileage obtained before the devices were installed on the trucks. With the system enabled by turning on the shutoff valve 58, both trucks achieved an average fuel consumption of 8 to 10 miles per gallon (approximately 3.8 kilometers per liter) while being driven approximately 200 miles (approximately 322 kilometers) for the same purposes as before. The same grade of diesel fuel was used at all times, the engines were not adjusted (except for the retuning after installation described above) and no fuel additives or additional devices were used. Further, after the system was enabled and run, as described above, the shut off valve 58 on the first truck was turned off and the first truck was used for 42 miles (approximately 67 kilometers), and the engine then obtained approximately 4.5 miles per gallon (approximately 1.9 kilometers per liter) when used for the same purposes as before.

EXAMPLE 2

The embodiment of FIG. 6 (except without a pump P) was installed on a 1992 Ford F250 pickup truck having a normally aspirated diesel V-8 engine with a displacement of 446 cubic inches (approximately 7,310 cubic centimeters), rated for 185 horsepower (approximately 138 kilowatts). Prior to installation of the device, this truck obtained approximately 12 miles per gallon (approximately 5.07 kilometers per liter) of diesel fuel while being driven approximately 40,000 miles (approximately 64,000 kilometers). After installation of the device, the truck obtained approximately 22 miles per gallon (approximately 9.3 kilometers per liter) while being driven approximately 1200 miles (approximately 1920 kilometers). The same grade of diesel fuel was used at all times, the engine was not adjusted (except for the retuning after installation described above) and no fuel additives or additional devices were used.

While the present invention has been disclosed in connection with the presently preferred embodiments described above, it will be obvious to those skilled in the art that changes and modifications can be made to the embodiments described above without departing from the scope and spirit of the invention. For example, and not by way of limitation, any configuration of fume injectors can be employed to inject fumes into the turbocharger or diesel engine. Further, any configuration of aerators or means for creating necessary suction or pressure to cause the necessary air flow can be used. Any type or configuration of control valves also can be used, as can any type or configuration of pumps. Accordingly, no limitations are to be inferred or implied in the scope of the invention except as explicitly and specifically set forth in the attached claims.

Industrial Applicability

This invention is applicable to any diesel powered internal combustion engine.

I claim:

1. An apparatus for increasing efficiency of a diesel engine supplied with diesel fuel from a diesel fuel tank, said engine having a turbocharger with a turbocharger fan located in a turbocharger inlet, comprising:

fume intake pipe in gaseous communication with said diesel fuel tank;

fume injector assembly spaced apart from said turbocharger fan, said fume injector assembly and said turbocharger fan defining an injector separation distance; and control valve operably connected between said fume intake pipe and said fume injector assembly;

whereby said turbocharger fan draws diesel fuel fumes from said diesel fuel tank, through said fume intake pipe, said control valve and said fume injector assembly, and injects said diesel fuel fumes into air flowing into said turbocharger inlet.

2. An apparatus according to claim 1, further comprising:

an aerator operably connected to said diesel fuel tank.

3. An apparatus according to claim 2, further comprising:

pipeline having an aerator portion and an air filter portion attached at said aerator portion to said aerator; and an aerator air filter attached to said air filter portion.

4. An apparatus according to claim 1, further comprising safety reservoir means operably connected between said diesel fuel tank and said control valve means for preventing diesel fuel flooding said apparatus.

5. An apparatus according to claim 1, wherein said injector separation distance is between approximately 1½ inches (approximately 4 centimeters) and approximately ½ inch (approximately 1.3 centimeters).

6. An apparatus according to claim 5, wherein said injector separation distance is approximately 1 inch (approximately 2.5 centimeters).

7. An apparatus according to claim 1, wherein said fume injector means comprises a plurality of fume injectors defining an array of fume injector outlet ends.

8. An apparatus according to claim 7, wherein said control valve means independently controls flow of fuel fumes through each of said plurality of said fume injectors.

9. An apparatus for increasing efficiency of a diesel engine supplied with diesel fuel from a diesel fuel tank, said engine having a turbocharger with a turbocharger fan located in a turbocharger inlet, comprising:

a fume intake pipe in gaseous communication with said diesel fuel tank;

a fume injector assembly spaced from said turbocharger fan, said fume assembly and said turbocharger fan defining an injector separation distance; and a control valve operably connected between said fume intake pipe and said fume injector assembly;

whereby said turbocharger fan draws diesel fuel fumes from said diesel fuel tank, through said fume intake pipe, said control valve and said fume injector assembly, and injects said diesel fuel fumes into air flowing into said turbocharger inlet;

wherein said fume injector assembly comprises a plurality of fume injectors defining an array of fume injector outlet ends;

wherein said array of fume injector outlet ends comprises a circular array of fume injector outlet ends approximately parallel to spaced apart from and concentric with, said turbocharger fan.

10. An apparatus according to claim 9, wherein said plurality of fume injectors comprises six fume injectors.

11. An apparatus according to claim 9, wherein said plurality of fume injectors comprises four fume injectors.

12. An apparatus according to claim 9, further comprising a centrally obstructing pipe spacer retained in the center of said circular array.

13. An apparatus according to claim 9 wherein said circular array has a diameter approximately half the diameter of said turbocharger fan.

14. An apparatus for increasing efficiency of a diesel engine supplied with diesel fuel from a diesel fuel tank, said engine having a turbocharger with a turbocharger fan located in a turbocharger inlet, comprising:

a fume intake pipe for receiving diesel fuel fumes having a fume intake end and a control valve end connected at said fume intake end to said diesel fuel tank;

a plurality of fume injector pipes each having an outlet end, said outlet ends being arranged in a circular array parallel to, spaced apart from, and concentric with said turbocharger fan, said circular array having a diameter approximately half the diameter of said turbocharger fan, said outlet ends being spaced at approximately equal angular distances in said array, each of said outlet ends being between approximately 1½ inches (approximately 4 centimeters) and approximately ½ inch (approximately 1.3 centimeters) from said turbocharger fan; and a control valve for independently controlling flow of said fuel fumes through each of said fume injector pipes operably connected between said control valve end of said fume intake pipe and each of said fume injector pipes;

whereby said turbocharger fan draws diesel fuel fumes from said diesel fuel tank, through said fume intake pipe, said control valve and said fume injectors and injects said diesel fuel fumes into air flowing into said turbocharger inlet.

15. An apparatus according to claim 14, further comprising:

an aerator for aerating said diesel fuel operably connected to said diesel fuel tank, whereby diesel fuel fumes are created in said diesel fuel tank.

16. An apparatus according to claim 15, further comprising a circular centrally obstructing pipe spacer retained in the center of said circular array.

17. An apparatus according to claim 14, wherein said plurality of fume injector pipes comprises six.

18. An apparatus according to claim 14, wherein said plurality of fume injector pipes comprises four.

19. An apparatus for increasing efficiency of a diesel engine supplied with diesel fuel from a diesel fuel tank, said engine having a turbocharger with a turbocharger fan located in a turbocharger inlet and an exhaust system, said fuel tank having an ullage defined by said diesel fuel in said fuel tank, comprising:

an aerator for aerating said diesel fuel mounted in said diesel fuel tank, whereby diesel fuel fumes are created in said ullage;

an aerator pipeline having first and second ends, said second end being attached to said aerator and said aerator pipeline being in thermal contact with said exhaust system;

an aerator air filter attached to said first end of said aerator pipeline;

a fume intake pipe having an intake end and a valve end mounted on said fuel tank and in gaseous communication with said ullage;

a plurality of fume injector pipes each having an outlet end, said outlet ends being arranged in a circular array parallel to, spaced apart from, and concentric with said turbocharger fan; and a control valve for independently controlling flow of said fuel fumes through each of said fume injector pipes operably connected between said valve end of said fume intake pipe and each of said fume injector pipes;

whereby said turbocharger fan draws air through said air filter said aerator pipeline and said aerator, thereby creating additional fuel fumes in said ullage, and whereby said turbocharger fan draws said diesel fuel fumes from said ullage, through said fume intake pipe, said control valve and said fume injector pipes and injects said diesel fuel fumes into air flowing into said turbocharger inlet.

20. An apparatus according to claim 19, wherein said plurality of fume injector pipes is equal to said cylinder number.

21. A process for increasing efficiency of a diesel engine supplied with diesel fuel from a diesel fuel tank, said engine having a turbocharger with a turbocharger fan located in a turbocharger inlet, comprising:

injecting diesel fuel fumes into air flowing into said turbocharger fan between approximately 1½ inches (approximately 4 centimeters) and approximately ½ inch (approximately 1.3 centimeters) from said turbocharger fan.

22. A process according to claim 21, wherein said injecting step is carried out by injecting said fuel fumes approximately one inch from said turbocharger fan.

23. A process according to claim 21, further comprising:

partially blocking air flow into said turbocharger inlet to accelerate said air flowing into said turbocharger.

24. An improved motor, comprising:

a diesel engine having a turbocharger with a turbocharger fan located in a turbocharger inlet supplied with diesel fuel from a diesel fuel tank;

fume intake means for receiving diesel fuel fumes in gaseous communication with said diesel fuel tank;

fume injector means for injecting said diesel fuel fumes into said turbocharger fan spaced apart from said turbocharger fan, said fume injector means and said turbocharger fan defining an injector separation distance; and control valve means for controlling flow of said diesel fuel fumes through said fume injector means operably connected between said fume intake means and said fume injector means;

whereby said turbocharger fan draws diesel fuel fumes injected by said fume injector means into air flowing into said turbocharger inlet.

25. An improved vehicle, comprising:

a body;

a diesel engine mounted in said body supplied with diesel fuel from a diesel fuel tank attached to said body and having a turbocharger with a turbocharger fan located in a turbocharger inlet, said diesel fuel forming diesel fuel fumes in said diesel fuel tank;

fume intake means in gaseous communication with said diesel fuel tank;

fume injector means having an outlet portion injecting said diesel fuel fumes from said outlet portion into said turbocharger fan spaced apart from said turbocharger fan, said outlet portion and said turbocharger fan defining an injector separation distance; and control valve means for controlling flow of said diesel fuel fumes through said fume injector means operably connected between said control valve portion of said fume intake means and said inlet portion of said fume injector means;

whereby said turbocharger fan draws fuel fumes injected by said fume injector means from said injector end into air flowing into said turbocharger inlet.

26. An apparatus for increasing efficiency of a normally aspirated diesel engine having a plurality of cylinders, each of said cylinders having an air intake valve adjacent thereto, said engine being supplied with diesel fuel from a diesel fuel tank, comprising:

fume intake means having a fume intake portion and a control valve portion connected at said fume intake portion to said diesel fuel tank;

fume injector means, each having an inlet end and an outlet end, each of said outlet ends spaced apart from a corresponding one of said intake valves by a distance of less than approximately one inch; and control valve means for independently controlling flow of said diesel fuel fumes through each of said fume injector means in gaseous communication between said control valve portion of said fume intake means and said inlet end of each of said fume injector means.

27. An apparatus according to claim 26, further comprising:

a pump for pumping said diesel fuel fumes from said diesel fuel tank through said fume injector means operably connected between said diesel fuel tank and said control valve means.

28. An apparatus according to claim 26, further comprising:

aerator means for aerating said diesel fuel to create diesel fuel fumes operably connected to said diesel fuel tank.

29. A process for increasing efficiency of a normally aspirated diesel engine having cylinders with air intake valves adjacent to each of said cylinders, air being provided to each of said air intake valves through an intake manifold, said engine being supplied with diesel fuel from a diesel fuel tank, comprising:

injecting diesel fuel fumes from said diesel fuel tank into said intake manifold less than one inch away from each of said air intake valves.

* * * * *